United States Patent [19]

Daubman et al.

[11] 3,963,175

[45] June 15, 1976

[54] FEEDCONE WITH ACCELERATOR VANES FOR IMPERFORATE BASKET

[75] Inventors: Edward A. Daubman; John W. Sherlock, both of East Moline, Ill.

[73] Assignee: Ametek, Inc., New York, N.Y.

[22] Filed: July 31, 1974

[21] Appl. No.: 493,331

[52] U.S. Cl. ..... 233/29; 233/46

[51] Int. Cl.[2] ..... B04B 11/06

[58] Field of Search ..... 233/21, 27, 28, 29, 233/30, 31, 32, 33, 34, 35, 36, 38, 46

[56] References Cited

UNITED STATES PATENTS

| | | | |
|---|---|---|---|
| 367,778 | 8/1887 | Backstrom | 233/38 |
| 585,936 | 7/1897 | Linders | 233/28 |
| 801,068 | 10/1905 | Fleming | 233/36 |
| 1,161,981 | 11/1915 | Sanford | 233/33 |
| 1,710,447 | 4/1929 | Bryson | 233/21 |
| 1,828,096 | 10/1931 | Bryson | 233/21 |
| 3,623,657 | 11/1971 | Trump | 233/29 |
| 3,730,423 | 5/1973 | Coulson | 233/38 |
| 3,779,450 | 12/1973 | Shapiro | 233/34 X |

FOREIGN PATENTS OR APPLICATIONS

| | | | |
|---|---|---|---|
| 26,115 | 3/1884 | Germany | 233/30 |
| 154,000 | 9/1904 | Germany | 233/31 |

*Primary Examiner*—George H. Krizmanich
*Attorney, Agent, or Firm*—Smythe & Moore

[57] ABSTRACT

A vertical centrifugal is provided with an imperforate basket and a center feedcone which discharges the feed stream at the bottom of the basket through a plurality of discharge tubes extending radially from the lower portion of the feedcone. Within the feedcone are provided a plurality of substantially vertically extended vanes for accelerating the liquid feed stream.

3 Claims, 4 Drawing Figures

FEEDCONE WITH ACCELERATOR VANES FOR IMPERFORATE BASKET

The present invention relates to centrifugals and, more particularly, to the center feedcone for a vertical centrifugal.

A centrifugal of the vertical-axis type has been provided with a center feedcone used in conjunction with a perforate basket. The feed stream is discharged close to the center of the basket sidewall. The solids which accumulate within the basket are then generally discharged through a central opening in the bottom wall of the basket. Such a centrifugal has been characterized by considerable splashing and turbulence of the liquid within the basket which is caused by the liquid being discharged from the feedcone in the basket which is already rotating at a relatively high speed. The impact of the newly introduced feed stream against the already rotating liquid in the basket gives rise to considerable turbulence within the basket. This turbulence and splashing is particularly objectionable since it interferes with the centrifugal sedimentation function of the basket.

One of the objects of the present invention is to provide an improved feedcone for a centrifugal.

Another of the objects of the present invention is to provide a center feedcone for a centrifugal employing an imperforate basket.

Another of the objects of the invention is to provide a feedcone which eliminates any turbulence during the supplying of the feed stream into the rotating basket.

According to one aspect of the present invention a centrifugal may comprise an imperforate basket mounted for rotation about a vertical axis. A feedcone is mounted within the basket along the rotary axis thereof. A plurality of discharge tubes extend radially from the lower portion of the feedcone and have their discharge openings directed at the bottom of the basket wall. Preferably these openings are located to direct the feed stream below the lowermost baffle within the basket. The feedcone may be provided with a plurality of substantially vertically extending vanes to accelerate the rotation of the feed stream as it is being supplied to the basket.

Other objects, advantages and features of the present invention will become apparent from the accompanying description and drawings, which are merely exemplary.

In the drawings.

Proceeding next to the drawings wherein like reference symbols indicate the same parts throughout the various views, a specific embodiment and modification of the present invention will be described in detail.

Figure 1:
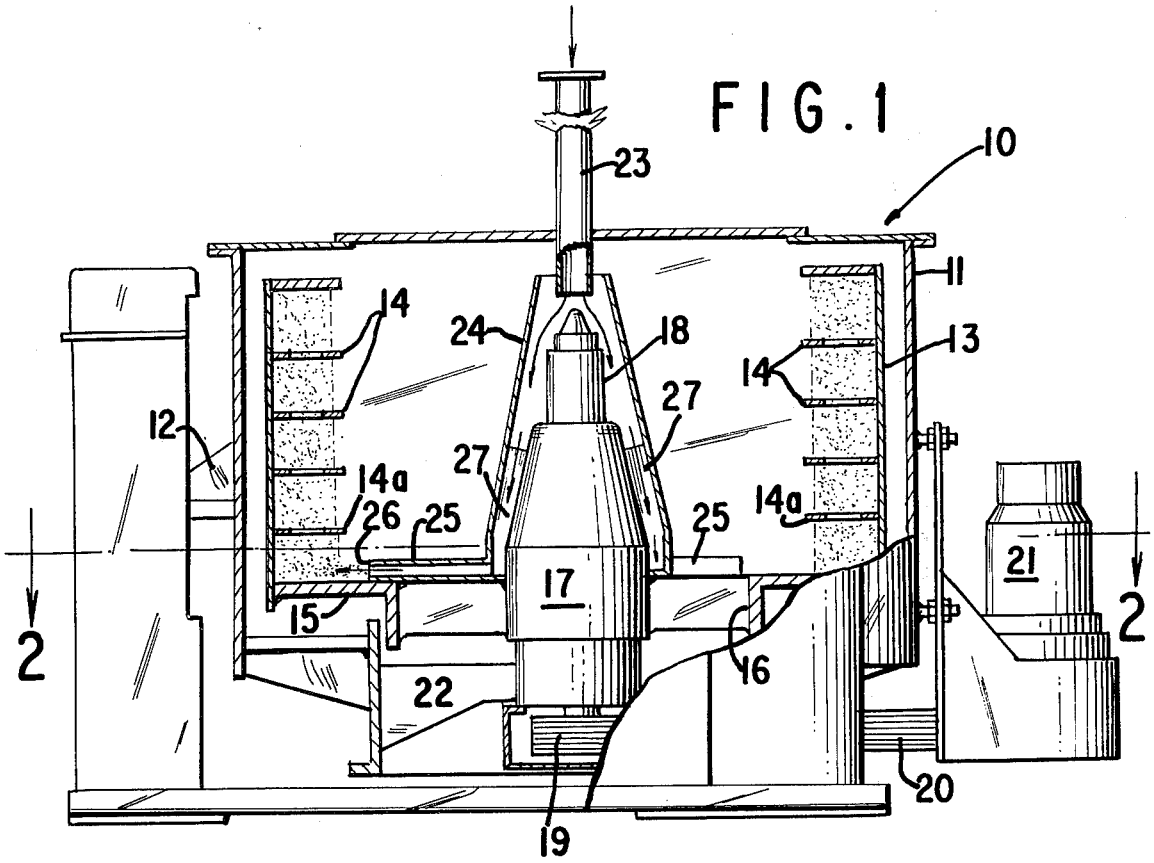
FIG. 1 is a vertical sectional view through a centrifugal incorporating the feedcone of the present invention.

In FIG. 1, there is illustrated generally at 10 a centrifugal incorporating the present invention which comprises an outer casing or housing 11 supported upon mounting brackets 12 and enclosing therein an imperforate basket 13 which is rotatable about its central vertical axis. The basket 13 comprises a plurality of horizontally extending baffles 14 spaced above a bottom wall 15 having a central opening 16 within which extends the central mounting structure 17 of the centrifuge. The center structure 17 is mounted upon a shaft 18 on the lower end of which is a pulley 19 drivingly connected by a drive belt or chain 20 to a drive motor 21.

A plurality of radially extending ribs 22 connect the bottom wall 15 of the basket to the central structure 17.

The feed stream is introduced into the centrifugal through a supply pipe 23 which is substantially coaxial with the rotary axis of the centrifugal. The supply pipe enters the upper end of a feedcone 24 which encloses the mounting structure 17 and extends to the bottom of the basket. Extending radially from the discharge bottom portion of the feedcone is a plurality of discharge tubes 25 which are substantially positioned over each of the ribs 22. Each discharge tube is provided with a discharge opening or port 26 which directs the feed stream against the inner surface of the basket wall 13 and below the lowermost baffle 14*a*.

Figure 2:
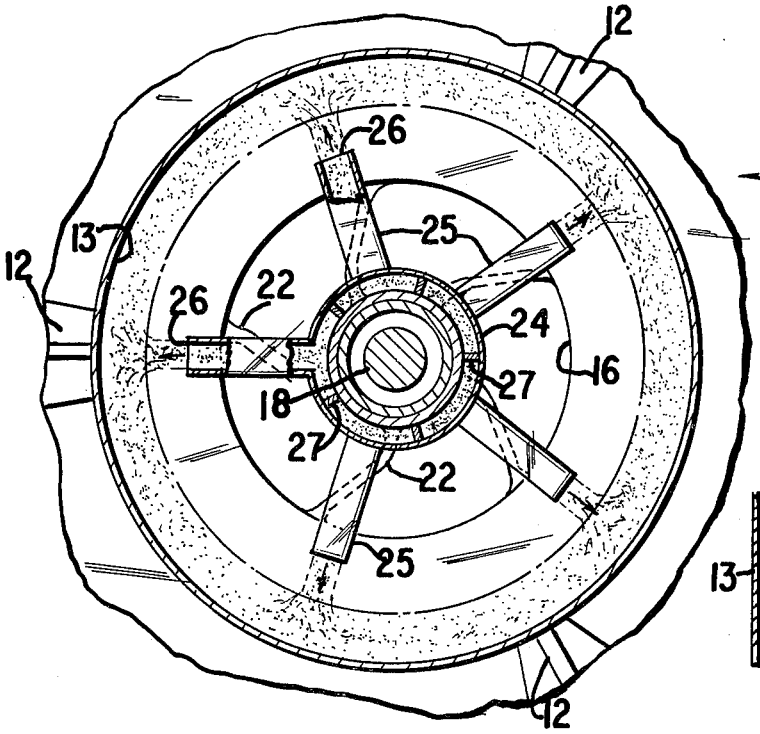
FIG. 2 is a sectional view taken along the line 2—2 of FIG. 1.
Figure 3:
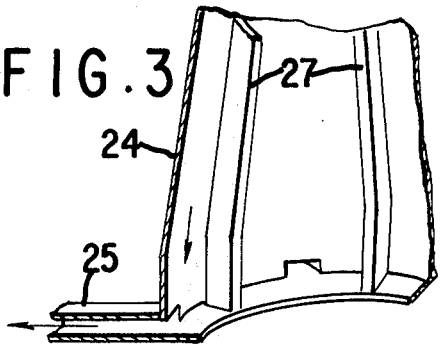
FIG. 3 is a perspective view of a portion of the feedcone according to the present invention showing the discharge tubes and accelerator vanes thereof.

Mounted within the feedcone 24 on the inner wall thereof are a plurality of substantially vertically extending accelerator vanes 27. The vanes 27 function to accelerate the liquid feed stream up to and approaching the velocity of rotation of the liquid in the basket. Therefore, when the feed stream is discharged from the ports 26, as shown in FIG. 2, splashing and turbulence of the rotating liquid in the basket itself is eliminated because the feed stream entering the basket is rotating at the same peripheral speed as the rotating liquid load in the basket.

By positioning the radial discharge tubes to coincide with the basket ribs in the solids discharge area of the basket, there is no blocking of the solids discharge area of the basket bottom, and any possible drippage or drooling of liquid down through the bottom of the basket during the feeding operation is prevented.

Figure 4:
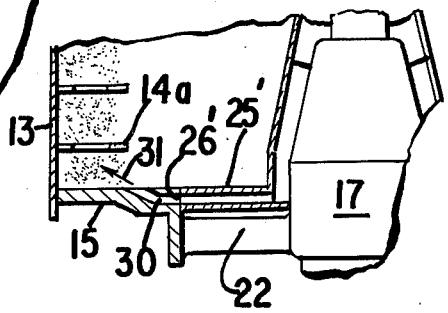
FIG. 4 is a portion of a view similar to that of FIG. 1 but showing a modification of the discharge tube structure.

In FIG. 4, there is shown a modification wherein the discharge tube 25′ is positioned so as to be flush with the bottom surface 15 of the basket. With this construction the discharge port 26′ is located below the bottom of the basket. Within the bottom of the basket, there are provided a corresponding plurality of passages 30, each of which coincides with one of the discharge ports. The passages have a horizontal portion which coincides with the discharge port, and the other end of passage 30 is inclined upwardly to direct the discharge stream upwardly as indicated at 31 but still below the lowermost baffle 14*a*.

Thus, is can be seen that the feedcone of the present invention eliminates splashing and turbulence of the rotating liquid in the basket. The elimination of the splashing enables the centrifugal sedimentation function of the basket to accur without disturbance.

It will be understood that changes in various details of construction and arrangement of parts may be made without departing from the spirit of the invention except as defined in the appended claims.

What is claimed is:

1. In a centrifugal, the combination of an imperforate basket mounted for rotation about a vertical axis and having a centrally disposed opening therein, a plurality of horizontal baffles on the inner wall surface of said basket, a plurality of substantially radially extending ribs for supporting the bottom wall of the basket, a feedcone mounted within said basket along the rotary axis thereof, and a plurality of discharge tubes extending radially from the lower portion of said feedcone across said opening above and generally aligned with said ribs, and a plurality of vertically extending vanes within said feedcone to accelerate the liquid supplied thereto as the liquid travels toward the discharge tubes.

2. In a centrifugal, as claimed in claim 1 wherein said discharge tubes are disposed below the bottom surface of the basket, and transversely and angularly disposed passage means in said basket bottom wall coinciding with the ports of said discharge tubes.

3. In a centrifugal as claimed in claim 2 wherein said passage means are directed upwardly toward the basket wall.

* * * * *